137-13 SR
11/9/76 XR 3,990,256

United States Patent [19]
May et al.

[11] 3,990,256
[45] Nov. 9, 1976

[54] METHOD OF TRANSPORTING GAS

[75] Inventors: Walter G. May, Summit; Donald E. Shaneberger, Port Murray, both of N.J.

[73] Assignee: Exxon Research and Engineering Company, Linden, N.J.

[22] Filed: Feb. 26, 1973

[21] Appl. No.: 335,927

Related U.S. Application Data

[63] Continuation of Ser. No. 128,867, March 29, 1971, abandoned.

[52] U.S. Cl. ..... 62/53; 62/55; 48/191; 48/196 R; 137/7; 137/13

[51] Int. Cl.[2] ..... F17C 7/02

[58] Field of Search ..... 62/52–55; 48/190, 191, 196; 137/7, 13

[56] References Cited

UNITED STATES PATENTS

| | | | |
|---|---|---|---|
| 2,958,205 | 11/1960 | McConkey | 62/54 |
| 3,656,312 | 4/1972 | Streich | 62/23 |

*Primary Examiner*—William F. O'Dea
*Assistant Examiner*—Ronald C. Capossela
*Attorney, Agent, or Firm*—Harold N. Wells; F. D. Paris

[57] ABSTRACT

A method of distributing natural gas by pipeline comprising pumping liquefied natural gas (LNG) for a predetermined portion of the desired distance, applying processes in which the refrigeration value of the gas is utilized and the high boiling point components are separated, and then vaporizing the remaining liquid prior to its being further transported by pipeline in the gaseous phase.

2 Claims, 1 Drawing Figure

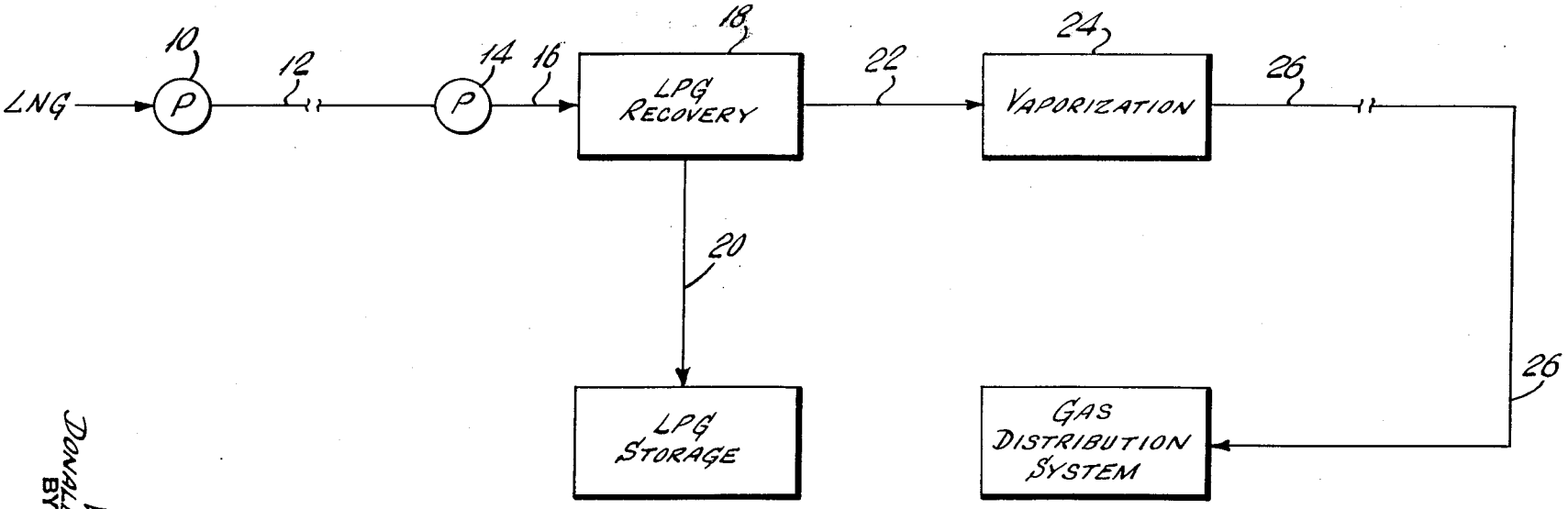
INVENTORS
WALTER G. MAY
DONALD E. SHANEBERGER
BY
F. Donald Paris
ATTORNEY

METHOD OF TRANSPORTING GAS

This is a continuation of application Ser. No. 128,867 filed Mar. 29, 1971, now abandoned.

BACKGROUND OF THE INVENTION

Liquefied natural gas (hereinafter referred to as LNG) has become an industrially important material. It is commonly used as a supplemental source of natural gas because of the relative ease of storing gas as liquid instead of in the gaseous form. In this way gas may be stored and later used for so-called "peak shaving" during periods when gas demand is very high. Another major reason for the importance of LNG is that natural gas is often found in remote locations, where it is of little value. Consequently, the natural gas may often be wasted. In order to utilize this gas, it is necessary to transport it to known markets. Although the transportation of gas by pipeline normally takes place over fairly lengthy distances, this would be no problem where only transportation over land is encountered. However, in many instances the natural gas is separated from its natural market by expansive bodies of water. As a result large plants have been developed at ports of embarkation to liquefy the natural gas for transportation by ship to the foreign markets. There the LNG may be vaporized and the gas directly introduced into the gas distribution system as it is required. However, if the LNG is to be moved to points somewhat remote from the shore terminals at which it is received, a decision must be made as to whether the LNG will be transported in the gaseous phase, as a liquid or by some other means.

The present invention will apply typically to the transportaton of LNG between the shoreline terminals where it is received from overseas locations by tanker and the point of ultimate use, which may be a gas distribution system many miles from the shore terminal.

The prior art has indicated several ways of accomplishing the aforementioned result. One way of transporting the natural gas would be to vaporize it at the shore terminal and transport it entirely by gas pipeline, as would be done if the gas had never been in the liquefied form. Another possibility would be transportation by rail or by truck. Still yet another possibility would be transportation by an LNG pipeline, that is to say, keeping liquid at all times throughout the pipeline so that it is received as a liquid at the distribution point. From there it would be vaporized for use by the ultimate consumer. Such a pipeline, discussed in U.S. Pat. No. 3,256,705, would necessarily be heavily insulated since LNG has an atmospheric boiling point of about −259° F. The pipeline would require intermediate cooling and repumping stations in order to maintain the gas in the liquid state. A continual heat in-leak would be expected throughout the pipeline which would vaporize the LNG and thereby create practical problems in its handling as well as reducing the capacity of the pipeline unless additional cooling were used.

An alternative method, which has been suggested in U.S. Pat. No. 2,958,205, would be to pump LNG, but instead of cooling it to prevent vaporization caused by heat in-leak deliberately allowing a certain portion of the LNG to vaporize to compensate for the heat in-leak. At predetermined locations the mixture of gas and liquid would be removed from the pipeline and separated. The gaseous portion would be compressed and reliquefied and the liquid portion repumped. Following this, the streams would be recombined and the pipeline would operate with only a liquid phase again until a certain distance was covered and the heat in-leak would cause vaporization to begin again.

The present invention provides a novel means of utilizing the inherent characteristics of LNG and at the same time providing a novel and improved method for transportation of the LNG to the ultimate consumer as will be seen in the description which follows below.

SUMMARY OF THE INVENTION

LNG is pumped to a pressure well above its bubble point so that it is substantially subcooled. It is sent through an insulated pipeline but heat leaks in from the surroundings and raises the temperature until a predetermined approach to the boiling point is reached. To prevent vaporization the LNG is repumped to a higher pressure and further transported. This process may be repeated but since no cooling is done the temperature of the LNG continues to rise until an optimum value is reached and the LNG is withdrawn from the pipeline for processing. The higher boiling hydrocarbons are removed by conventional means. Thereafter various processes are carried out to make use of the resulting lower boiling and higher boiling hydrocarbons. After such processing, the remainder of the natural gas is vaporized and transported by pipeline at essentially ambient temperatures to the gas distribution point where it may be passed directly into the gas distribution system without further processing. The present invention thus makes maximum use of the potential of the cold liquefied gas while transporting the gas in a most efficient manner.

BRIEF DESCRIPTION OF THE DRAWING

The drawing shows a schematic diagram of the transportation system to be described more completely below illustrating a typical arrangement for the intermediate station at which the LNG is utilized and then vaporized for further transporation.

DESCRIPTION OF THE PREFERRED EMBODIMENT.

LNG leaves its shore based tankage and is pumped by a conventional pump 10 into a pipeline 12 which extends typically for many miles. During the passage of the LNG along the pipeline 12 the heat input to the line from the surroundings gradually warms the LNG towards its bubble point. At a predetermined point before the bubble point has been reached, a pump 14 is used to repressure the LNG to avoid any vaporization at this particular time. It will be understood that the process of repressuring and transporting LNG may take place more than once before the intermediate station for separation and/or vaporization is reached. The pump 14 also serves to provide pressure which will be needed after the processing steps to supply the gas to the pipeline downstream through which it will ultimately reach the gas distribution system and the consumer.

Pump 14 pumps through line 16 into the LPG (liquefied petroleum gas) separation facilities shown as 18. The hydrocarbon components heavier than methane would be separated by conventional facilities such as fractionation. Included in such facilities might also be systems which would recover energy from the cold and provide power for pump operation such as is shown in U.S. Pat. No. 3,266,261. Alternatively, the refrigeration value of the LNG might be used for various processing purposes where the low temperatures involved would be useful, e.g. food processing or the like. It should be noted that while the LNG at the intermediate station is much warmer lthan at the beginning of its journey, the temperature is low enough to provide refrigeration for many commercially useful processes. Extensive heat integration could be used to provide maximum economy and minimum cost.

Another envisioned possibility is the removal of the heavy ends of the LNG and their use in production of chemical raw materials. In the basic case which is considered, the LNG would be separated by conventional processing into its component parts and the heavy ends used either for chemical manufacture or for fuel.

Following the separation processes, the LNG would be in a partially vaporized state at which time it would pass via line 22 to the vaporization station designated 24 wherein it would be vaporized by conventional heat exchange or by fired heaters to completely vaporize the remaining gas. It is to be understood that, in the detailed design, optimum use would be made of the cold within the LNG in order to minimize the expenditure of energy for vaporization of the gas.

After vaporization, the LNG would then be warmer and it could be passed through a conventional type of gas pipeline 26 which would not require special materials of construction or special insulation. The gas would continue to the gas distribution system and the ultimate consumer.

In a typical example of such a line 600 million cubic feet a day would be transported in a liquid state through a 16 inch diameter pipe insulated with about 2 inches of polyurethane foam in the following manner. With LNG at atmospheric pressure and −263° F., the pressure would be increased to 450 psia with only a slight increase in temperature. As the liquid flows through the pipe the pressure drops due to pipe friction while temperature increases due to heat gain from the surroundings as previously mentioned. After flowing a distance of 36 miles the liquid would be at about 50 psia and −238° F. Any further decrease in pressure and/or temperature increase would result in boiling. The boiling condition should be avoided since the capacity of the line would be seriously decreased by vapor formation. A second pumping station then would be utilized to return the pressure to 450 psia. After flowing another 33 miles the boiling condition would again be approached and a third pumping station would be required. Proceeding in this manner and using a total of six pumping stations, the liquid could be transported 160 miles. After 160 miles the liquid would be at 270 psia and −172° F. For this example this would be approximately the optimum distance for the flow rate and the pressure level. Transmission in the liquid phase beyond the optimum distance requires refrigeration and would be unattractive economically. At this point the liquid would be pumped to 900 psia and vaporized. If heavier components are to be separated out, the liquid would be pumped to a lower pressure, e.g. 500 psia to facilitate the separation and the methane rich fraction later compressed if necessary. Maximum recovery would be made of the cold in the LNG. The resulting methane rich vapor being at least at −20° F. and 900 psia, the gas would be transferred by conventional pipeline techniques.

Having discussed in detail the present invention, which basically comprises transporting LNG first in liquid form and then in gaseous form and taking advantage of the cold inherent in the liquefied state while making the phase transition, it is apparent that a number of other variations are possible. Thus, for example, variations of processes could be used at the intermediate stations which are in themselves conventional and would not necessarily result in a deviation from the scope of this invention as herein described and set forth in the following claims.

What is claimed is:

1. A method of transporting natural gas comprising:

a. liquefying and subcooling the natural gas at a base station;

b. pressurizing the liquefied natural gas at said base station to a pressure sufficient to prevent vaporization of said liquefied natural gas due to heat in leakage during transport;

c. transporting said liquefied natural gas by pipeline for a predetermined distance until a predetermined approach to the boiling point of said gas is reached;

d. repressuring said liquefied natural gas to suppress vaporization;

e. repeating steps (c) and (d) until a predetermined optimum temperature and pressure is reached coincident with the arrival of said liquefied natural gas at an intermediate vaporizing station;

f. receiving said liquefied natural gas at said intermediate station;

g. repressuring and vaporizing said liquefied natural gas completely at the intermediate station to predetermined pressure and temperature suitable for distributing vaporized gas thereby avoiding reliquefaction facilities and including processes which use the refrigeration value of said liquefied natural gas and thereby add heat to said gas; and h. transporting said vaporized natural gas by pipeline from the intermediate station to the terminal station from which the gas is distributed.

2. A method of transporting natural gas comprising:

a. liquefying and subcooling the natural gas at a base station;

b. pressuring the liquefied natural gas at said base station to a pressure sufficient to prevent vaporization of said liquefied natural gas due to heat in leakage during transport;

c. transporting said liquefied natural gas by pipeline for a predetermined distance until a predetermined approach to the boiling point of said gas is reached;

d. repressuring said liquefied natural gas to suppress vaporization;

e. repeating steps (c) and (d) until a predetermined optimum temperature and pressure is reached coincident with the arrival of said liquefied natural gas at an intermediate vaporizing station;

f. receiving said liquefied natural gas at said intermediate station;

g. separating said liquefied natural gas at said intermediate station into fractions, at least one of said fractions consisting essentially of methane;

h. repressuring and completely vaporizing said fraction consisting essentially of methane at a predetermined pressure and temperature suitable for distributing vaporized gas and wherein this step and step (g) include cold recovery processes for minimizing the energy required in the separation and vaporization processes; and i. transporting said vaporized fraction consisting essentially of methane by pipeline from the intermediate station to the terminal station from which the gas is distributed.

* * * * *